United States Patent [19]

Focke

[11] Patent Number: 4,562,686

[45] Date of Patent: Jan. 7, 1986

[54] APPARATUS FOR CLOSING FOLDED CARDBOARD BOXES

[75] Inventor: Heinz Focke, Verden, Fed. Rep. of Germany

[73] Assignee: Focke & Co., Verden, Fed. Rep. of Germany

[21] Appl. No.: 525,925

[22] Filed: Aug. 24, 1983

[30] Foreign Application Priority Data

Sep. 9, 1982 [DE] Fed. Rep. of Germany ..... 3233471

[51] Int. Cl.[4] ..... B65B 7/16; B31B 1/25

[52] U.S. Cl. ..... 53/374; 53/75; 53/528; 493/183

[58] Field of Search ..... 493/61, 80, 183; 53/22, 53/23, 374, 75, 208, 528

[56] References Cited

U.S. PATENT DOCUMENTS

| | | | |
|---|---|---|---|
| 3,015,197 | 1/1962 | Eichorn | 53/374 |
| 3,953,956 | 5/1976 | Massman | 53/124 B |
| 4,430,842 | 2/1984 | Focke | 53/220 |

*Primary Examiner*—Francis S. Husar
*Assistant Examiner*—William E. Terrell
*Attorney, Agent, or Firm*—Sughrue, Mion, Zinn, Macpeak & Seas

[57] ABSTRACT

To close folded cardboard boxes having different filling levels, the box content is detected by a sensing ram and, according to the data detected in this way, scoring is then carried out on the box closing tabs so that it can then be closed by folding the closing tabs along the score lines. Scoring blades are connected to the sensing ram via toggle levers in such a way that after the sensing ram has been set down on the box contents, the scoring blades are moved outwards against the inner face of the closing tabs.

6 Claims, 4 Drawing Figures

APPARATUS FOR CLOSING FOLDED CARDBOARD BOXES

BACKGROUND OF THE INVENTION

The invention relates to apparatus for closing the closing tabs of a folded cardboard box; and more specifically to scoring apparatus which score the closing tabs along folding lines which coincide with the upper level of the box contents.

The cardboard box is arranged to accommodate a number of relatively small packets, such as packets of roasted coffee. These packets may be made from paperboard, cardboard, and the like and thus exhibit substantial dimensional variations within a rather broad range of tolerances.

To adapt the dimensions of the folded cardboard box to its contents, the level of the packets in the box are sensed and, the closing tabs of the cardboard box are provided with score lines which coincide with the sensed level of the packets.

In a known apparatus using the process mentioned above, a sensing ram is lowered onto the upper level of boxed packets. When the uppermost level of the packets is detected by the sensing ram, pressing tools located outside the box are activated. These press the closing tabs against inner scoring edges located on the sensing ram to form scores on the closing tabs along folding lines about which the closing tabs are subsequently folded. In this known apparatus, the pressing or scoring tools are activated by an actuating bolt against spring stress (U.S. Pat. No. 4,430,842).

In another known apparatus, a ram plate is set down on the contents in a folded cardboard box. At the same time, laterally arranged scoring plates are pivoted into the working position. Press means engaging the outside of the cardboard box press the closing tabs of the box against the scoring plates, so that a folding mark is formed at the desired height (U.S. Pat. No. 3,953,956).

The known apparatuses are expensive to construct and handle and are susceptible to malfunction especially those using actuating means which are stressed by pressure-medium cylinders.

SUMMARY OF THE INVENTION

The object of the invention is to provide an apparatus of the type mentioned in the background, which is of simple construction and easy to handle and which guarantees a largely automatic movement cycle.

To achieve this object, the apparatus according to the invention is characterized in that the scoring tools are actuated by a sensing ram as the sensing ram contacts the upper level of the box contents.

The sensing ram is linked to the scoring tools to provide a positive control of the movement cycle such that immediately after the sensing means reaches the fill level of the box, the scoring tools are actuated to produce folding marks on the closing tabs.

The sensing ram and scoring tools are preferably moved into and out of the working position by a common movement means, preferably an actuating rod. The sensing means is first conveyed downwardly by the actuating rod against the box contents. Further movement of the actuating rod causes the scoring tools to be activated. These are appropriately arranged on the inner face of the box closing tabs and are moved outwards against the closing tabs via an actuating linkage in the form of toggle levers. As the apparatus returns to its initial position as a result of the upward movement of the actuating rod, the scoring tools are first drawn inwardly and then upwardly together with the sensing means.

According to a further feature of the invention, all the components of the apparatus are arranged on a common holder and can be moved up and down together by means of the actuating rod displaceably mounted in the holder.

BRIEF DESCRIPTION OF THE DRAWINGS

Exemplary embodiments of the invention are explained in more detail below with reference to the drawings in which.

DETAILED DESCRIPTION OF THE PREFERRED EMBODIMENTS

Figure 1:
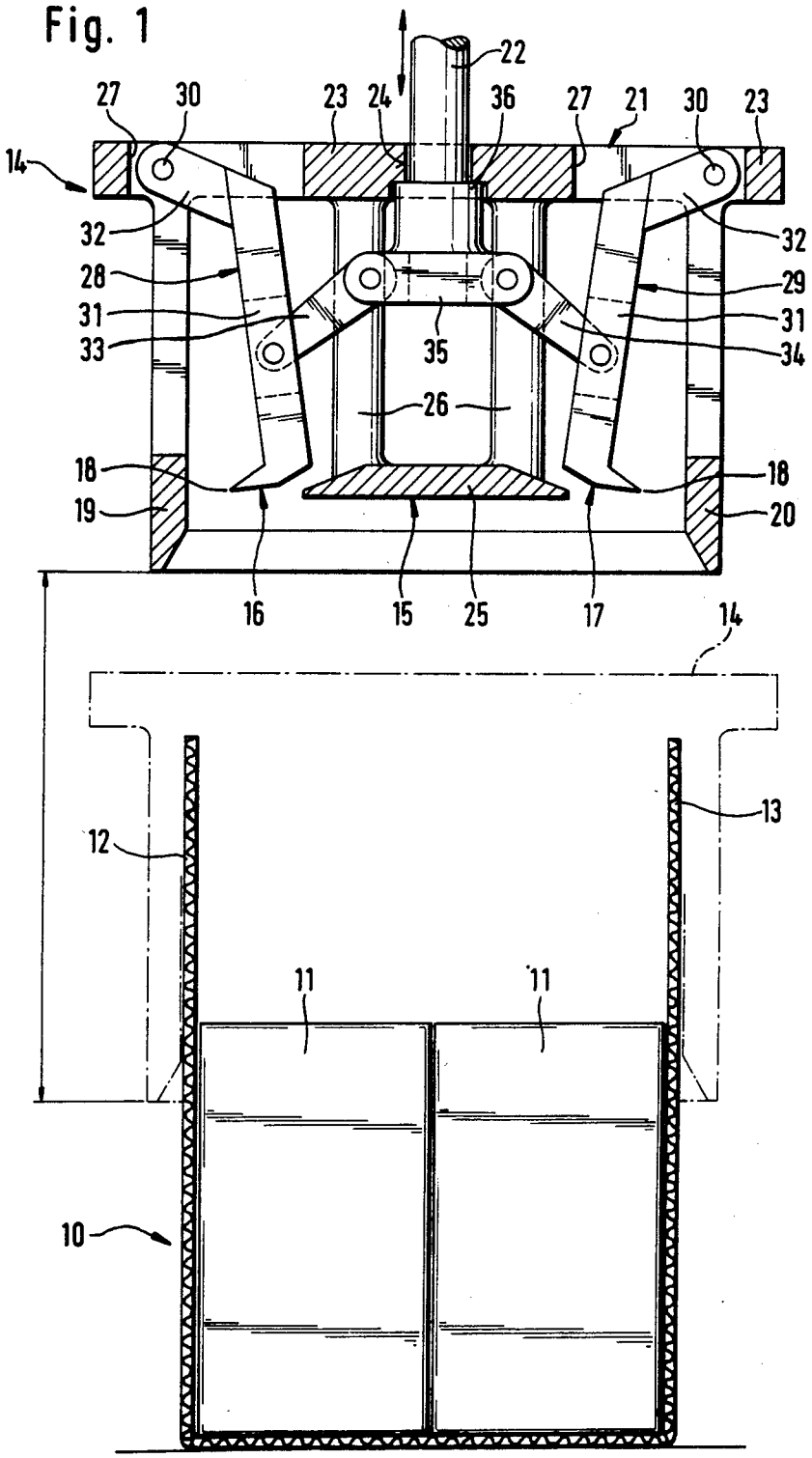
FIG. 1 shows a vertical section of an exemplary embodiment of the apparatus in the initial position.
Figure 2:
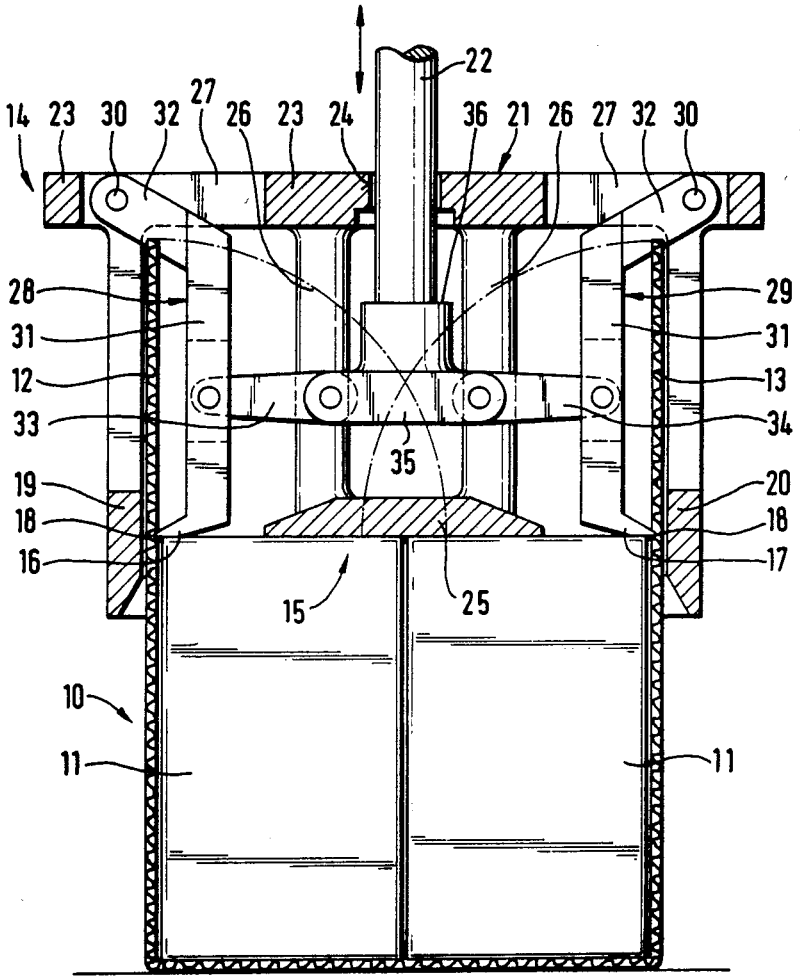
FIG. 2 shows a vertical section of the apparatus according to FIG. 1 in the lowered or working position.

FIGS. 1 and 2 illustrate a folded cardboard box 10 made, for example, of corrugated cardboard. This box is designed to receive a number of small packets 11, for example coffee packets. The packets 11 are introduced into the folded cardboard box to fill its interior. The open, top side of filled cardboard box 10 is to be closed by means of closing tabs 12 and 13. These are folded out of the upright position shown by being folded inwardly over packets 11.

For this purpose, the closing tabs 12 and 13 receive, in the plane of the top side of the packets 11, a marking or scoring, along which the closing tabs 12, 13 are folded.

A scoring device 14, which can be lowered onto the folded cardboard box 10, is used to score the closing tabs 12 and 13. The scoring device 14 includes a sensing means in the form of a sensing ram 15 having a sensing plate 25 which can rest on the upper level of the boxed packets 11, and if appropriate compress them slightly. The scoring device also includes scoring tools in the form of laterally extendably, elongate scoring blades 16, 17 each with a sharpened scoring edge 18 for scoring the inner faces of the closing tabs 12, 13.

The above-mentioned scoring tools are located on the inside of the folded cardboard box 10 and particularly on the inside of the closing tabs 12, 13. A counter-tool in the form of a counter-pressure strip 19, 20 is located on the outer sides of the box, opposite the scoring blades 16, 17.

The above-mentioned components are located on a common hood-shaped holder 21 which can be moved as a unit by a movement means in the form of an actuating rod 22. The rod 22 is mounted to slide in a central bore 24 of an upper supporting plate 23 of the holder 21.

The sensing ram 15 is arranged concentrically to the actuating rod 22 in the central region of the underside of the supporting plate 23. The sensing plate 25 is supported on the supporting plate 23 by legs 26. The actuating rod 22 is movable between the legs 26.

In the region openings 27 in the supporting plate 23, the scoring blades 16, 17 and their respective supporting arms 28 and 29 are pivotably mounted via joints 30. The supporting arms 28, 29 consist of an essentially vertical leg 31, on the lower end of which is located the outward-projecting angled scoring blade 16, 17, and an upper leg 32 which is angled in relation to the leg 31 and which is mounted via the joint 30 within the opening 27 to the supporting plate 23. The scoring blades 16, 17 are thereby movable through a large circular arc.

The scoring blades 16, 17 are directly activated to move outwardly and then inwardly by the actuating rod 22. For this purpose, the actuating rod 22 is connected to the respective supporting arms 28, 29 of the scoring blades 16, 17 via an actuating linkage in the form of toggle levers 33 and 34, respectively. The ends of the toggle levers 33, 34 facing the actuating rod 22 are articulated to a connection plate 35 located on the lower end of the actuating rod 22.

In the initial position, the scoring device 14 is centered above the folded cardboard box 10. At the same time, the actuating rod 22 assumes its upper position in relation to the holder 21. In this position, a shoulder-like stop 36 comes up against the underside of the supporting plate 23. As the actuating rod 22 moves downward, the holder 21 is moved down over the open folded cardboard box 10, in such a way that the counter-pressure strips 19, 20 extend along the outer face of the folded cardboard box 10. The sensing plate 25 of the sensing ram 15 comes up against the top of the packets 11, terminating further downward movement of the holder 21. Further downward movement of the actuating rod 22 causes the toggle levers 33, 34 to be extended. Consequently, the scoring blades 16, 17 are moved or pivoted outwards, until the scoring edges 18 come up against the closing tabs 12 and 13 in the plane of the upper level of the boxed packets. The dimensions are chosen so that the extended position of the toggle levers 33, 34 at the same time determines the end position of the scoring blades 16, 17.

After the scoring operation has ended, the actuating rod 22 is moved upwards, during which operation the scoring blades 16, 17 first move inwards, its supporting arms 28, 29, pivoting above joint 30. Then, the entire holder 21 is moved upwards. Consequently, the relative movements are effected by utilizing the deadweight of the holder 21. Alternatively, the scoring movements can be executed against the force of restoring springs or the like.

Figure 3:
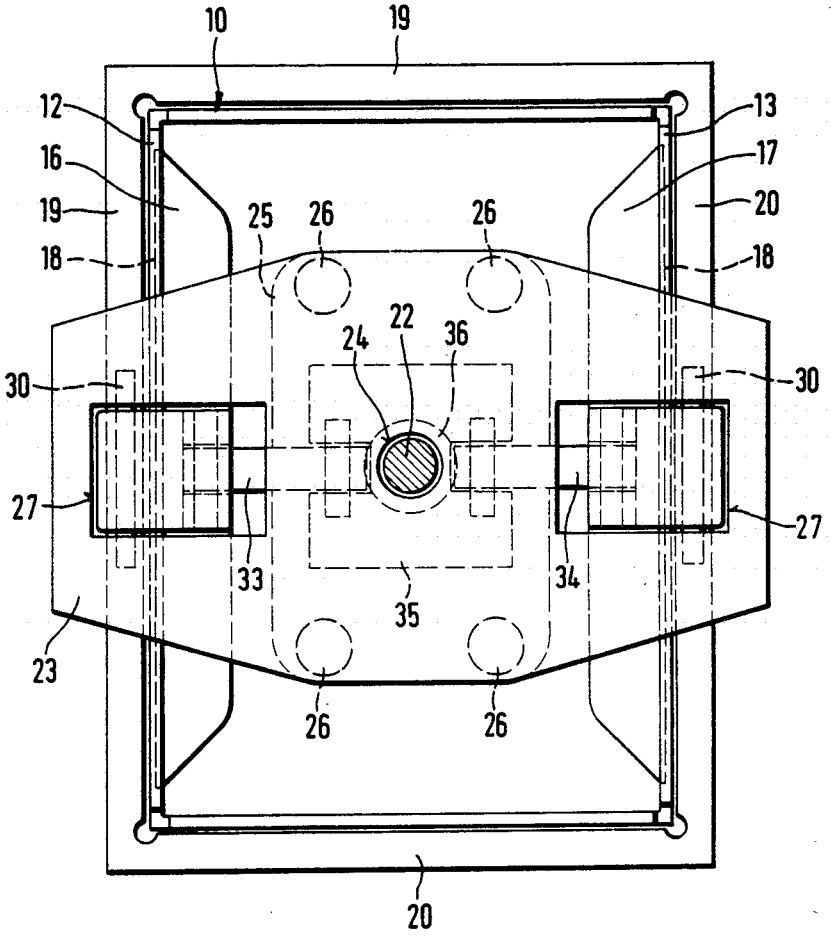
FIG. 3 shows the apparatus according to FIGS. 1 and 2 in a horizontal projection or plan view.

As is evident from FIG. 3, the scoring device 14 can be designed so that only two scoring blades 16, 17 are provided, extending in the region of the long sides of a rectangular folded cardboard box 10. Accordingly, scores are made only in the region of two closing tabs 12 and 13 located opposite one another.

Figure 4:
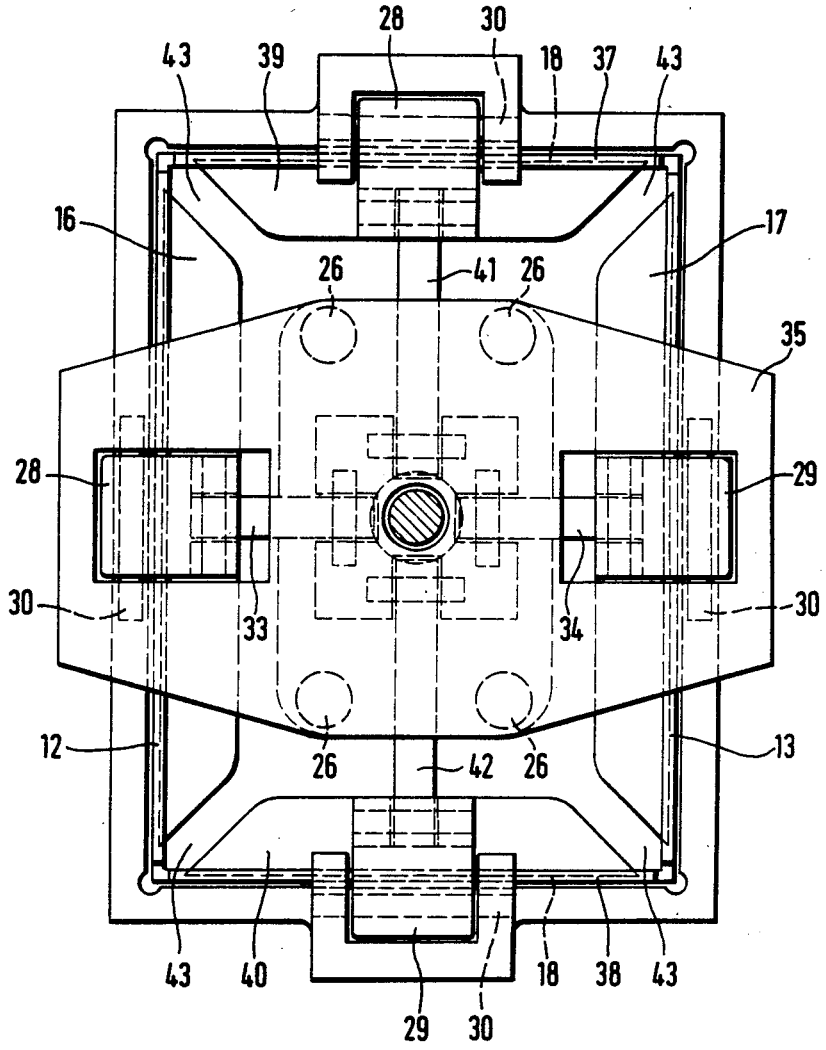
FIG. 4 shows a representation corresponding to FIG. 3 of another exemplary embodiment of the apparatus.

In the exemplary embodiment according to FIG. 4, additional, shorter closing tabs 37 and 38 are provided. These closing tabs are scored at the height of the top of the packets 11 by blades 39 and 40. The blades 39, 40 are connected to the supporting plate 23 of the holder 21 in the way described with reference to FIGS. 1 to 3. Furthermore, the blades 39 and 40 can be activated via toggle levers 41 and 42. The toggle levers mentioned above are mounted, together with the toggle levers 33 and 34, on the common connection plate 35 at the lower end of the actuating rod 22.

The blades 16, 17 and 39, 40 extend over virtually the entire length of their associated closing tabs 12, 13 and 37, 38. In the region of the corners, an approximately diagonally directed recess 43 is left between the adjacent scoring blades. It is thereby possible for these to move free of constraint.

What is claimed is:

1. In a device for closing the closing flaps (12, 13; 37, 38) of a filled box (10) made of foldable material, a scoring device for scoring the inside surfaces of the closing flaps along folding lines which coincide with the upper level of the box contents (11) comprising:

a vertically movable sensing ram (15) for sensing the upper level of the box contents;

an actuating rod (22) connected to said sensing ram for vertically moving said sensing ram;

a supporting plate (23);

scoring blades (16, 17; 39, 40) each with a scoring edge (18);

supporting arms (28, 29) pivotably attached to said supporting plate (23) about joints (30), each supporting arm being connected to a respective scoring blade, whereby each of said scoring blades is movable along an arc defined by the scoring blade's supporting arm as it pivots about a joint (30); and toggle levers (33, 34; 41, 42), one end of each toggle lever being pivotably connected to said actuating rod (22), the other end of each toggle lever being pivotably connected to a respective supporting arm (28, 29), said actuating rod (22) being positioned movably within an opening (24) of said supporting plate (23) such that the pivot points of the toggle levers on said actuating rod are all located below the joints (30) about which the supporting arms (28, 29) pivot relative to the supporting plate (23).

2. In the device for closing the closing flaps (12, 13; 37, 38) of a filled box (10) as claimed in claim 1, wherein said scoring blades (16, 17; 39, 40) are movable through the movement of said actuating rod (22) against the inner faces of said closing flaps, and further including counter pressure means (19, 20) located adjacent the position of the outer faces of said closing flaps and facing to said scoring blades.

3. In the device for closing the closing flaps (12, 13; 37, 38) as claimed in claim 2, further including a common hood-like holder (21) of which the supporting plate (23) is a part, and to which the sensing ram (15) and counter pressure means (19, 20) are attached.

4. In the device for closing the closing flaps (12, 13; 37, 38) as claimed in claim 3, wherein said hood-like holder (21) is movable, and wherein said hood-like holder can be moved by said actuating rod (22).

5. In the device for closing the closing flaps (12, 13; 37, 38) as claimed in claim 4, wherein said supporting arms (28, 29) with their scoring blades (16, 17; 39, 40) are connected to the toggle levers (33, 34; 41, 42) and the toggle levers are connected to the actuating arm in a manner such that they are brought to a retracted position away from the inner faces of the closing flaps by the dead weight of the holder (21) as it moves relative to said actuating rod (22).

6. In the device for closing the closing flaps (12, 13; 37, 38) as claimed in claim 5, wherein the extended positions of the toggle levers (33, 34; 41, 42) determine the end positions of said scoring blades which cause scoring of the closing tabs.

* * * * *